US012359886B2

(12) United States Patent
Underwood et al.

(10) Patent No.: US 12,359,886 B2
(45) Date of Patent: Jul. 15, 2025

(54) MUZZLE DEVICE ASSEMBLIES

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 18/442,324

(22) Filed: Feb. 15, 2024

(65) Prior Publication Data

US 2024/0280340 A1 Aug. 22, 2024

Related U.S. Application Data

(60) Provisional application No. 63/446,526, filed on Feb. 17, 2023.

(51) Int. Cl.
*F41A 21/36* (2006.01)
*F41A 21/38* (2006.01)

(52) U.S. Cl.
CPC ..... *F41A 21/38* (2013.01)

(58) Field of Classification Search
CPC ..... F41A 21/34; F41A 21/36; F41A 21/38
See application file for complete search history.

(56) References Cited

U.S. PATENT DOCUMENTS 812,140 A * 2/1906 Kent ..... F41A 21/28 89/14.3
2,212,683 A * 8/1940 Hughes ..... F41A 21/36 89/14.3
2,883,781 A * 4/1959 Harvey ..... F41A 21/38 42/105
4,322,999 A * 4/1982 Aston ..... F41A 21/36 89/14.3
4,879,942 A * 11/1989 Cave ..... F41A 21/36 89/14.3
4,945,812 A * 8/1990 Mazzanti ..... F41A 21/36 89/14.3
5,305,677 A * 4/1994 Kleinguenther ..... F41A 21/36 89/14.3
5,549,030 A * 8/1996 Lespron ..... F41A 21/36 89/14.3
6,820,530 B2 * 11/2004 Vais ..... F41A 21/36 89/14.3
9,228,789 B1 * 1/2016 Oglesby ..... F41A 21/36
9,303,939 B1 * 4/2016 Brinkmeyer ..... F41A 21/38
9,310,152 B1 * 4/2016 Poling ..... F41A 21/36
10,036,605 B1 * 7/2018 Kosman ..... F41A 21/38
10,209,022 B1 * 2/2019 Oglesby ..... F41A 21/34
10,612,878 B1 * 4/2020 Salvador ..... F41A 21/325
10,845,150 B1 * 11/2020 Oglesby ..... F41A 21/34
11,397,066 B1 * 7/2022 Oglesby ..... F41A 21/325
2011/0174141 A1 * 7/2011 Adolphsen ..... B29C 39/10 89/14.3
2012/0048100 A1 * 3/2012 Davies ..... F41A 21/34 89/14.2

(Continued)

*Primary Examiner* — Derrick R Morgan

(57) ABSTRACT

A muzzle device assembly for a firearm includes a body and a rear member attached to a rear of the body. The body includes a plurality of openings on a left side and a plurality of openings on a right side. There are at least one pair of openings on a top of the body. The at least one pair of openings intersect one another and form a common hole at an interior surface of the body.

20 Claims, 9 Drawing Sheets

(56) References Cited

U.S. PATENT DOCUMENTS

| | | | | |
|---|---|---|---|---|
| 2012/0228052 | A1* | 9/2012 | Findlay | F41A 21/36<br>42/90 |
| 2012/0317853 | A1* | 12/2012 | Butler | F41A 21/34<br>42/1.06 |
| 2013/0199071 | A1* | 8/2013 | Lee | F41A 21/325<br>42/1.06 |
| 2013/0227871 | A1* | 9/2013 | Stone | F41A 21/30<br>42/76.1 |
| 2014/0075800 | A1* | 3/2014 | Morris, Jr. | F41A 21/36<br>42/1.06 |
| 2015/0308778 | A1* | 10/2015 | Vossler | F41A 21/34<br>89/14.3 |
| 2017/0205178 | A1* | 7/2017 | Niswander | F41A 21/325 |
| 2018/0238654 | A1* | 8/2018 | Barry | F41A 21/36 |
| 2020/0292269 | A1* | 9/2020 | Guillen | F41A 21/36 |
| 2021/0088302 | A1* | 3/2021 | Joplin | F41A 21/36 |
| 2025/0035397 | A1* | 1/2025 | Olsen | F41A 21/36 |

* cited by examiner

MUZZLE DEVICE ASSEMBLIES

CROSS REFERENCE TO RELATED APPLICATION

This application is related to and claims priority benefit from U.S. Provisional Application No. 63/446,526 ("the '526 application"), filed on Feb. 17, 2023. The '526 application is hereby incorporated in its entirety by this reference.

FIELD OF THE INVENTION

The field of the invention relates to muzzle device assemblies for firearms, particularly muzzle device assemblies designed to be attached to the muzzles of various firearms.

BACKGROUND

Many modern firearms are designed with a threaded portion at the muzzle of the barrel. The threaded portion allows for various components to be attached including muzzle devices, flash hiders, muzzle brakes, threaded covers/caps, suppressors, and other relevant devices. Such devices may function to reduce noise and/or light at the muzzle of the firearm. In addition, these devices may channel or redirect the flow of gases such that some of the gases that would typically flow straight out the muzzle of the firearm follow one or more different paths. Many of these products follow traditional designs based on industry standards and/or military specification (milspec). In addition, many traditional products require consumable parts, such as crush washers, to be installed on the appropriate barrel.

To improve comfort and ergonomics while also reducing installation complexity, muzzle rise, muzzle flash, and noise, it may be desirable to design new muzzle device assemblies that can be adapted for multiple barrel configurations.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, a muzzle device assembly for a firearm comprises: a body; and a rear member attached to a rear of the body, wherein: the body comprises a plurality of openings on a left side of the body and a plurality of openings on a right side of the body; at least one pair of openings on a top of the body; and the at least one pair of openings intersect one another and form a common hole at an interior surface of the body.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-8 illustrate components of rifle or carbine style firearms, the features, concepts, and functions described herein are also applicable (with potential necessary alterations for particular applications) to handguns, rifles, carbines, pistols, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, 0.410 gauge, 10 gauge, 16 gauge.

Figure 1:
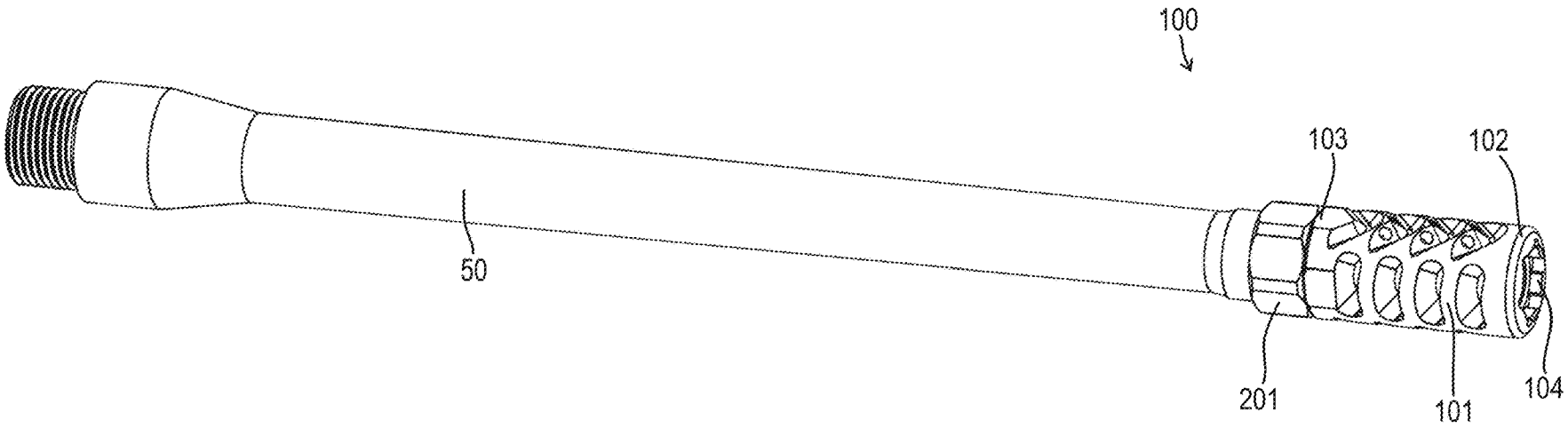
FIG. 1 is a perspective view of a muzzle device assembly attached to a barrel according to certain embodiments of the present invention.
Figure 2:
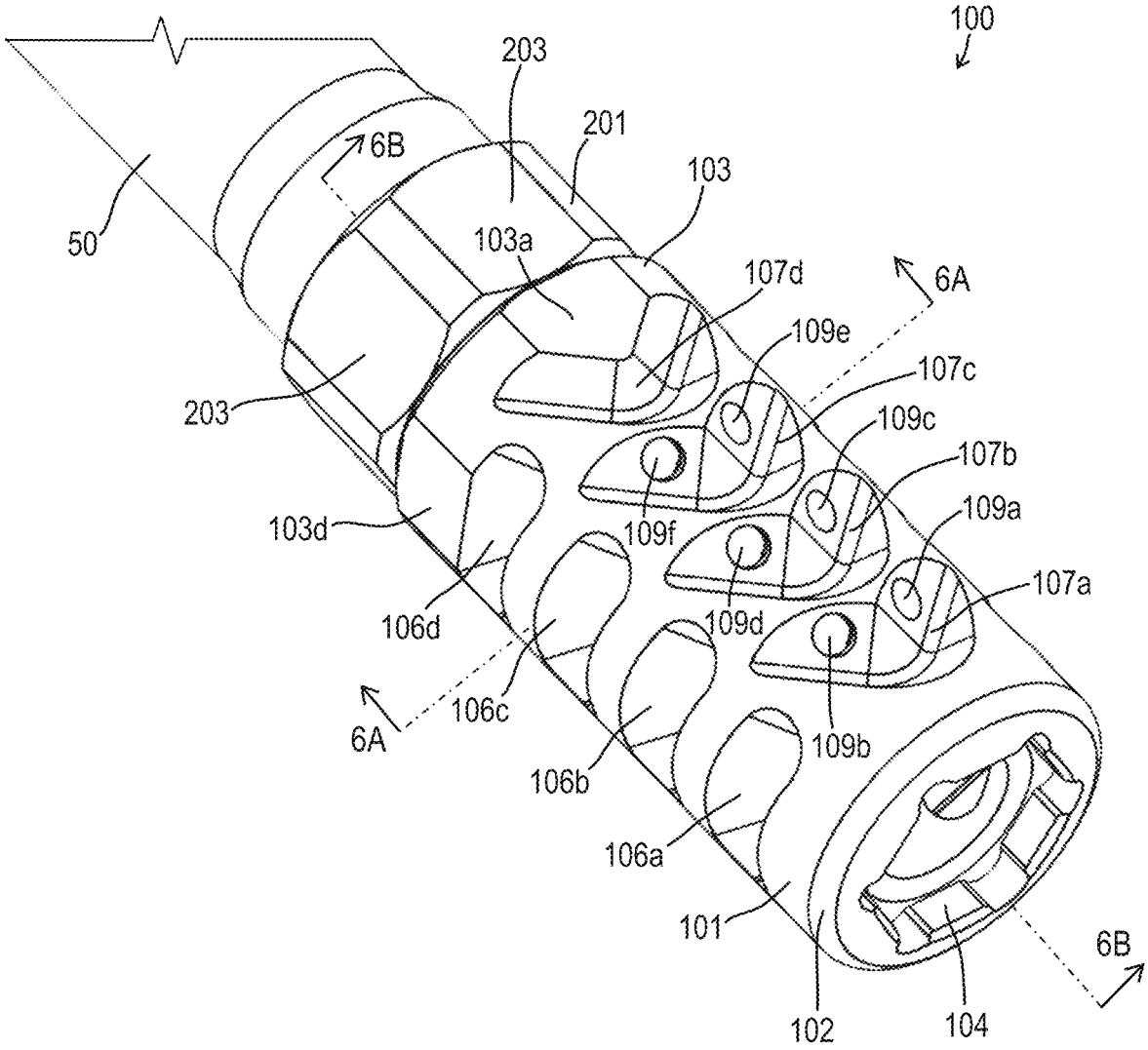
FIG. 2 is a front top perspective view of the muzzle device assembly of FIG. 1.

In some embodiments, as shown in FIGS. 1 and 2, a muzzle device assembly 100 attaches to a barrel 50 and includes a body 101 and at least one rear member 201. The body 101 may include a forward end 102, an aft end 103, a front recess 104, at least one left side opening 105, at least one right side opening 106, at least one upper recess 107, at least one lower recess 108, and/or at least one recess opening 109 (see FIGS. 2-8). As shown in FIGS. 5-8, at or adjacent to the aft end 103, the body 101 may include an inner attachment portion 111 and/or an outer attachment portion 112. In some embodiments, the inner attachment portion 111 is a threaded portion designed to interface with a threaded muzzle of a firearm barrel (e.g., barrel 50 shown in FIGS. 1 and 2). The inner attachment portion 111 may be a female threaded member (see FIGS. 5 and 7B). As shown in FIGS. 6A-8, the outer attachment portion 112 may be a threaded portion designed to interface with a threaded portion of the rear member 201 (i.e., attachment portion 202). In some embodiments, the body 101 does not include the outer attachment portion 112 and there is no rear member 201. The rear member 201 may be a nut, and in some cases, may be a jam nut. As described above, for embodiments that include a rear member 201, there may be an attachment portion 202, which in some cases is a female threaded member (see FIGS. 7A-8). In some embodiments, the outer attachment portion 112 and the attachment portion 202 are right hand thread (or standard threads). In other embodiments, the outer attachment portion 112 and the attachment portion 202 are left hand thread (or reverse threads). When the inner attachment portion 111 is a threaded member, this member is designed to match the threads of the appropriate firearm barrel. In some cases, the outer attachment portion 112 and attachment portion 202 interface is threaded opposite of the inner attachment portion 111. For example, if the inner attachment portion 111 is right hand thread, the outer attachment portion 112 and attachment portion 202 interface is left hand thread. Similarly, if the inner attachment portion 111 is left hand thread, the outer attachment portion 112 and attachment portion 202 interface is right hand thread. Arranging these two interfaces with opposite threads allows the body 101 to be threaded onto the barrel 50 and the rear member 201 to be threaded to push against the body 101 to lock the components in position.

Figure 3:
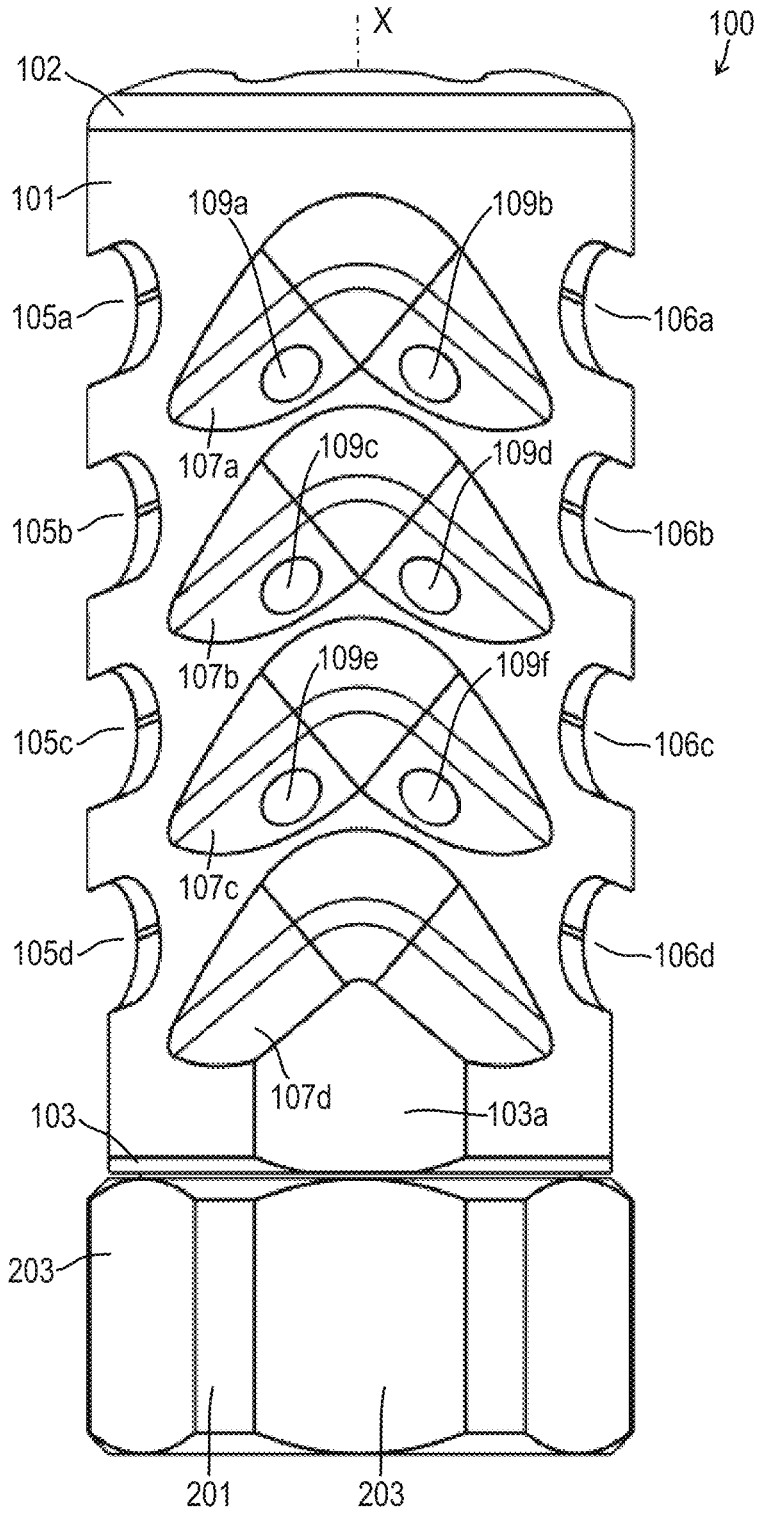
FIG. 3 is a top view of the muzzle device assembly of FIG. 1.
Figure 4:
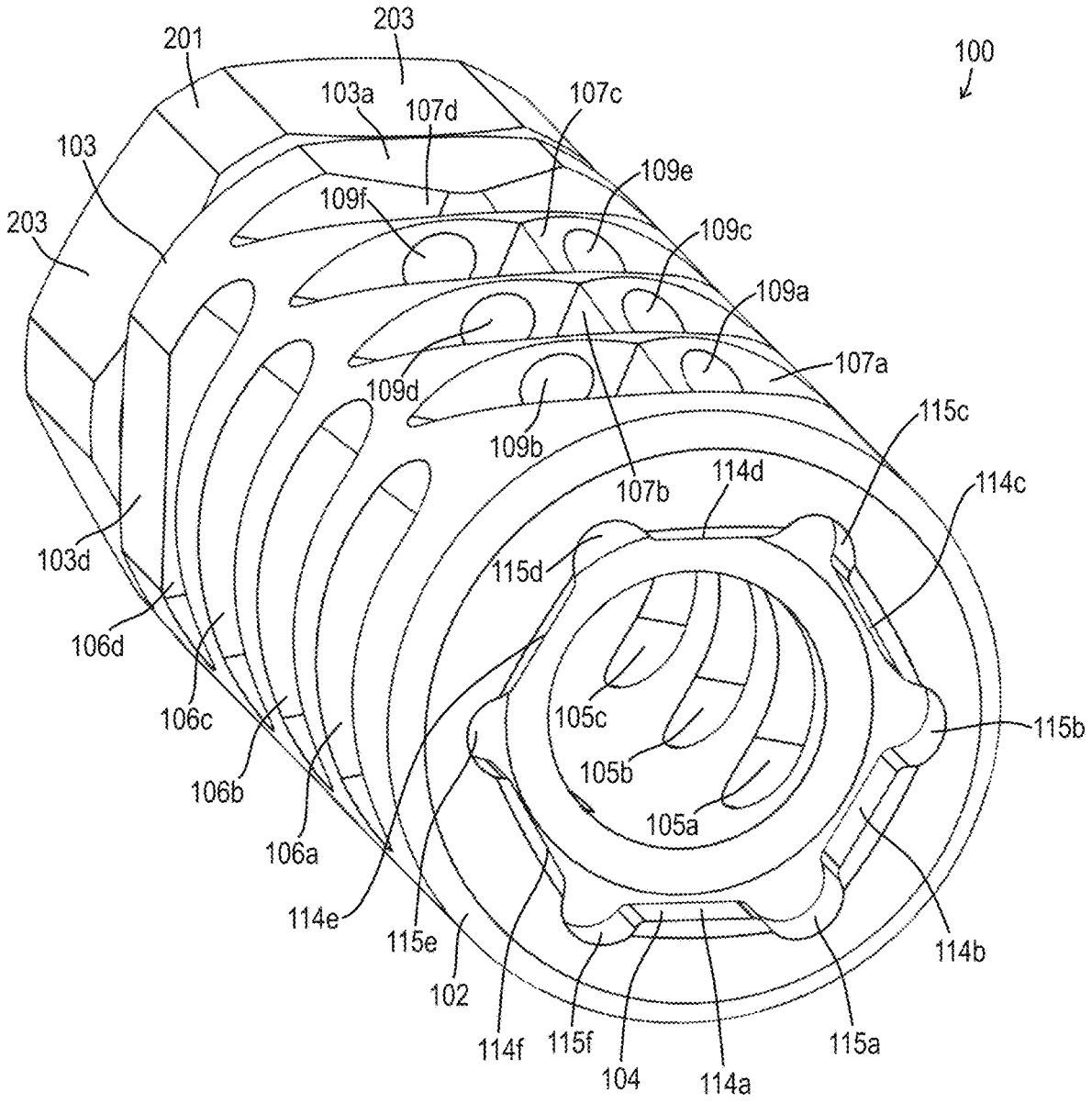
FIG. 4 is a front perspective view of the muzzle device assembly of FIG. 1.

As shown in FIGS. 2-8, the body 101 includes a plurality of openings 105, 106 that extend from the interior of the body 101 to the exterior and allow some gases to pass through the body 101 (before reaching the downstream end of the body 101). On the left side, the body 101 may include at least one left side opening 105. The at least one left side opening 105 may be a plurality of openings 105. For example, as shown in FIGS. 3-6B, the body 101 may include four left side openings 105*a*, 105*b*, 105*c*, 105*d*. In some embodiments, as shown in FIG. 3, the left side opening(s) 105 are arranged at an oblique angle relative to the bore axis X. In other embodiments, the left side opening(s) 105 may be perpendicular to the bore axis X. The left side opening(s) 105 may be angled toward the rear of the body 101 (see FIG. 3). In some embodiments, the left side opening(s) 105 are angled toward the rear between approximately 5° and 85° beyond horizontal. In certain embodiments, the left side opening(s) 105 are angled toward the rear between approximately 10° and 80° beyond horizontal. In some embodiments, the left side opening(s) 105 are angled toward the rear between approximately 20° and 70° beyond horizontal. In certain embodiments, the left side opening(s) 105 are angled toward the rear between approximately 15° and 30° beyond horizontal. In some embodiments, the left side opening(s) 105 are angled toward the rear between approximately 20° and 25° beyond horizontal. On the right side, the body 101 may include at least one right side opening 106. The at least one right side opening 106 may be a plurality of openings 106. For example, as shown in FIGS. 3-8, the body 101 may include four right side openings 106*a*, 106*b*, 106*c*, 106*d*. In some embodiments, as shown in FIG. 3, the right side opening(s) 106 are arranged at an oblique angle relative to the bore axis X. In other embodiments, the right side opening(s) 106 may be perpendicular to the bore axis X. The right side opening(s) 106 may be angled toward the rear of the body 101 (see FIG. 3). In some embodiments, the right side opening(s) 106 are angled toward the rear between approximately 5° and 85° beyond horizontal. In certain embodiments, the right side opening(s) 106 are angled toward the rear between approximately 10° and 80° beyond horizontal. In some embodiments, the right side opening(s) 106 are angled toward the rear between approximately 20° and 70° beyond horizontal. In certain embodiments, the right side opening(s) 106 are angled toward the rear between approximately 15° and 30° beyond horizontal. In some embodiments, the right side opening(s) 106 are angled toward the rear between approximately 20° and 25° beyond horizontal.

After a bullet is fired and passes through the barrel 50 and the muzzle device assembly 100, gases will follow the bullet traveling along the bore axis X. The openings 105, 106 allow some gases to exit through the body 101 in a direction not parallel to the bore axis X. In some cases, gases exiting the barrel 50 and entering the muzzle device assembly 100 will first reach the left side opening 105*d* and the right side opening 106*d* such that (due to the high pressure) some of the gases will exit through the openings 105*d*, 106*d*. As described above, the openings 105*d*, 106*d* may be angled rearward (i.e., beyond horizontal, closer to the rear than the front of the body 101). After entering the muzzle device assembly 100 the gases that do not exit through the openings 105*d*, 106*d* will reach the left side opening 105*c* and the right side opening 106*c* such that (due to the high pressure) some of the gases will exit through the openings 105*c*, 106*c*. As described above, the openings 105*c*, 106*c* may be angled rearward (i.e., beyond horizontal, closer to the rear than the front of the body 101). After entering the muzzle device assembly 100 the gases that do not exit through the openings 105*c*, 105*d*, 106*c*, 106*d* will reach the left side opening 105*b* and the right side opening 106*b* such that (due to the high pressure) some of the gases will exit through the openings 105*b*, 106*b*. As described above, the openings 105*b*, 106*b* may be angled rearward (i.e., beyond horizontal, closer to the rear than the front of the body 101). After entering the muzzle device assembly 100 the gases that do not exit through the openings 105*b-d*, 106*b-d* will reach the left side opening 105*a* and the right side opening 106*a* such that (due to the high pressure) some of the gases will exit through the openings 105*a*, 106*a*. As described above, the openings 105*a*, 106*a* may be angled rearward (i.e., beyond horizontal, closer to the rear than the front of the body 101).

In some embodiments, the purpose of angling the openings 105, 106 rearward is to reduce some of the recoil forces created when a cartridge is fired. The explosion and subsequent movement of the bullet and gases through the barrel 50 and muzzle device assembly 100 creates forces in the forward direction that push the firearm rearward. The arrangement of the openings 105, 106 allows some gases to be expelled rearward, which creates forces in the rear direction that push the firearm forward (to partially counteract the recoil forces created by firing a cartridge). Angling the openings 105, 106 more toward the rear would create more/stronger forces to more effectively counteract the recoil forces. However, angling the openings 105, 106 more toward the rear would also cause more gases (and potentially other materials) to be expelled toward the operator's face.

To facilitate manipulation and attachment of the body 101 and the rear member 201, the body 101 includes at least one tool interface portion 103*a-d* and the rear member 201 includes at least one tool interface portion 203. For example, as shown in FIGS. 2-8, the body 101 includes a plurality of tool interface portions and, in some cases, includes four tool interface portions 103*a*, 103*b*, 103*c*, 103*d*. Two of the opposing tool interface portions (e.g., 103*a* and 103*c*) can be engaged using a tool (e.g., a wrench). For example, as shown in FIGS. 2-5 and 7A-8, the rear member 201 includes a plurality of tool interface portions and, in some cases, includes six tool interface portions 203 (e.g., a hex nut). Two of the opposing tool interface portions can be engaged using a tool (e.g., a wrench).

In addition, the body 101 may include a front recess 104 to facilitate manipulation and attachment. For example, the recess 104 may include a plurality of surfaces 114 and a plurality of corners 115 for interfacing with a tool. In some embodiments, the recess 104 includes six surfaces 114*a*, 114*b*, 114*c*, 114*d*, 114*e*, 114*f*. The surfaces 114 may be configured to engage with a hex wrench or a hex key. The optional corners 115*a-f* may provide material relief in the corners to ensure a hex wrench fits into the front recess 104.

As shown in FIGS. 2-8, the body 101 includes at least one upper recess 107 and at least one lower recess 108. In some embodiments, the recesses 107, 108 do not pass through the walls of the body 101. The recess(es) 107, 108 may each be configured in a "v" shape. On the top side, the body 101 may include a plurality of recesses 107. For example, as shown in FIGS. 2-4, 7A, and 8, the body 101 may include four upper recesses 107*a*, 107*b*, 107*c*, 107*d*. On the bottom side, the body 101 may include a plurality of recesses 108. For example, as shown in FIGS. 5-6B and 7B, the body 101 may include four lower recesses 108*a*, 108*b*, 108*c*, 108*d*.

In some embodiments, as shown in FIGS. 2-4, 6A-7A, and 8, the body 101 may include at least one opening that extends through an inner surface created by one of the recess(es) 107, 108 into the interior to allow some gases to pass through the body 101 (before reaching the downstream end of the body 101). For example, the body 101 may include a plurality of recess openings 109 that each extend from a surface created by a respective upper recess 107 to the interior of the body 101. Although the drawings illustrate recess openings 109 for the upper recess(es) 107, the body 101 may include opening(s) 109 on or adjacent to other features including, for example, the lower recess(es) 108. As shown in FIGS. 2-4, 7A, and 8, recess openings 109*a*, 109*b* may each extend from a surface within the upper recess 107*a*, recess openings 109*c*, 109*d* may each extend from a surface within the upper recess 107*b*, and recess openings 109*e*, 109*f* may each extend from a surface within the upper recess 107*c*.

The recess opening(s) 109 may be designed to extend from the interior of the body 101 to the exterior to allow gases to pass through the body 101. In some embodiments, each opening 109 is perpendicular to (i.e., normal to) the respective adjacent surface of the appropriate recess 107. Based on the geometry and contours of the recess(es) 107, the recess opening(s) 109 are oblique with respect to the bore axis X in at least one direction. For example, when starting from the surface of recess 107*a* and moving toward the interior of the body 101, the opening 109*a* may extend rearward and/or may extend toward the right side of the body 101. Similarly, when starting from the surface of recess 107*a* and moving toward the interior of the body 101, the opening 109*b* may extend rearward and/or may extend toward the left side of the body 101. In some embodiments, opening 109*a* and opening 109*b* are symmetric with one another and are configured to intersect when entering the interior of the body 101 at a common hole 110*a* (see FIG. 5).

When starting from the surface of recess 107*b* and moving toward the interior of the body 101, the opening 109*c* may extend rearward and/or may extend toward the right side of the body 101. Similarly, when starting from the surface of recess 107*b* and moving toward the interior of the body 101, the opening 109*d* may extend rearward and/or may extend toward the left side of the body 101. In some embodiments, opening 109*c* and opening 109*d* are symmetric with one another and are configured to intersect when entering the interior of the body 101 at a common hole 110*b* (see FIG. 5).

When starting from the surface of recess 107*c* and moving toward the interior of the body 101, the opening 109*e* may extend rearward and/or may extend toward the right side of the body 101. Similarly, when starting from the surface of recess 107*c* and moving toward the interior of the body 101, the opening 109*f* may extend rearward and/or may extend toward the left side of the body 101. In some embodiments, opening 109*e* and opening 109*f* are symmetric with one another and are configured to intersect when entering the interior of the body 101 at a common hole 110*c* (see FIGS. 5-6B).

Figure 5:
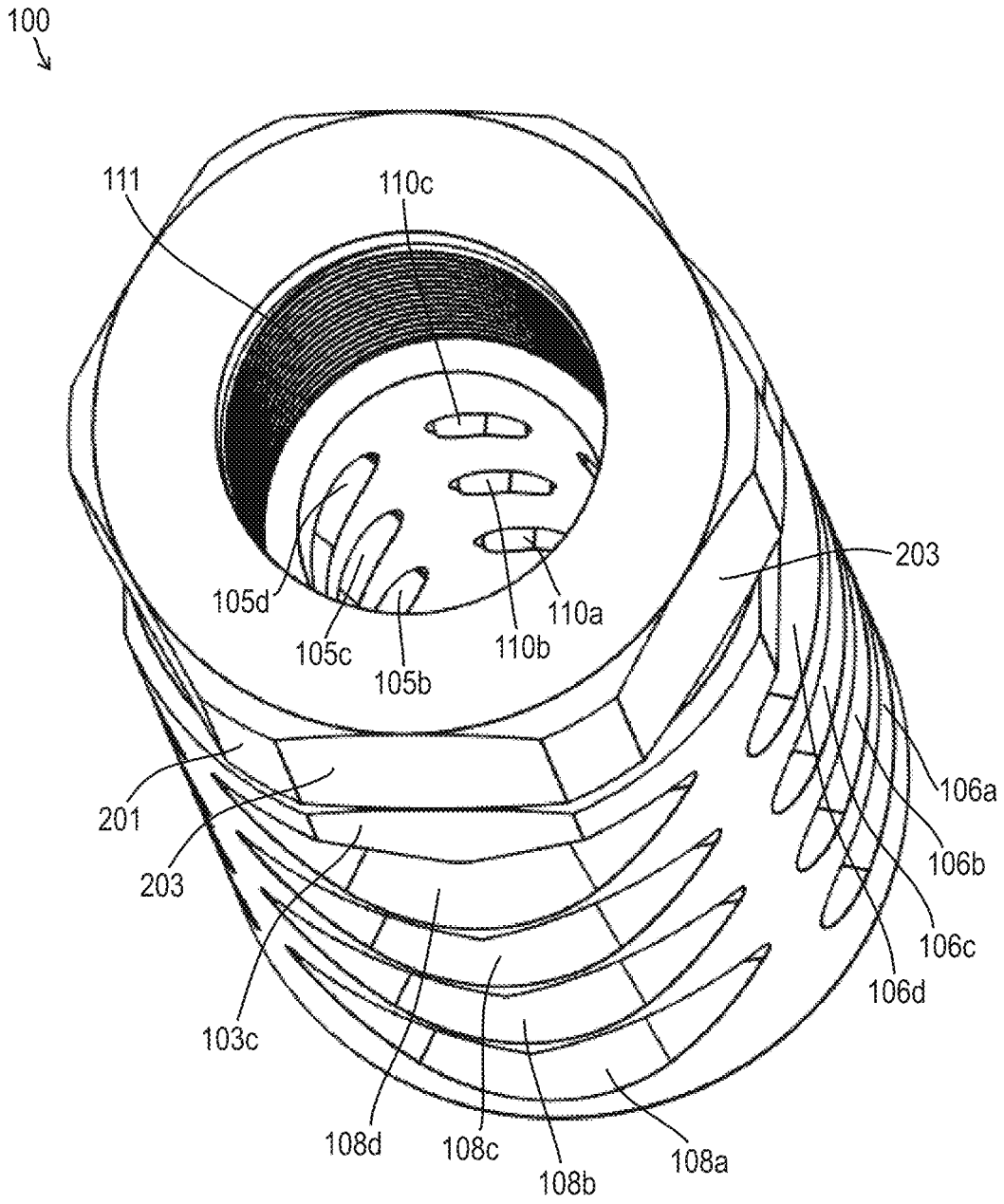
FIG. 5 is a rear bottom perspective view of the muzzle device assembly of FIG. 1.
Figure 6A:
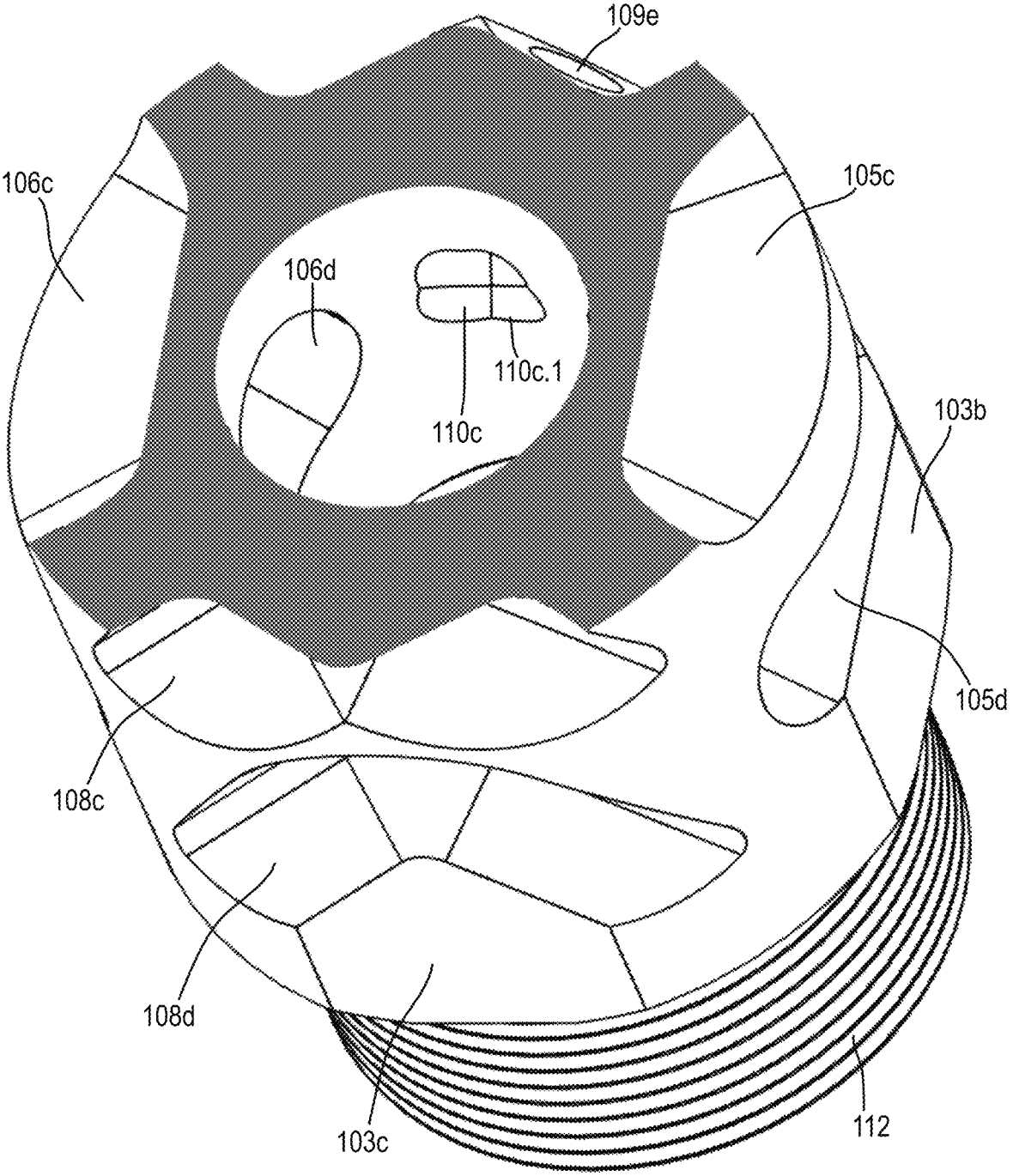
FIG. 6A is a cross-section view of the muzzle device assembly of FIG. 2.
Figure 6B:
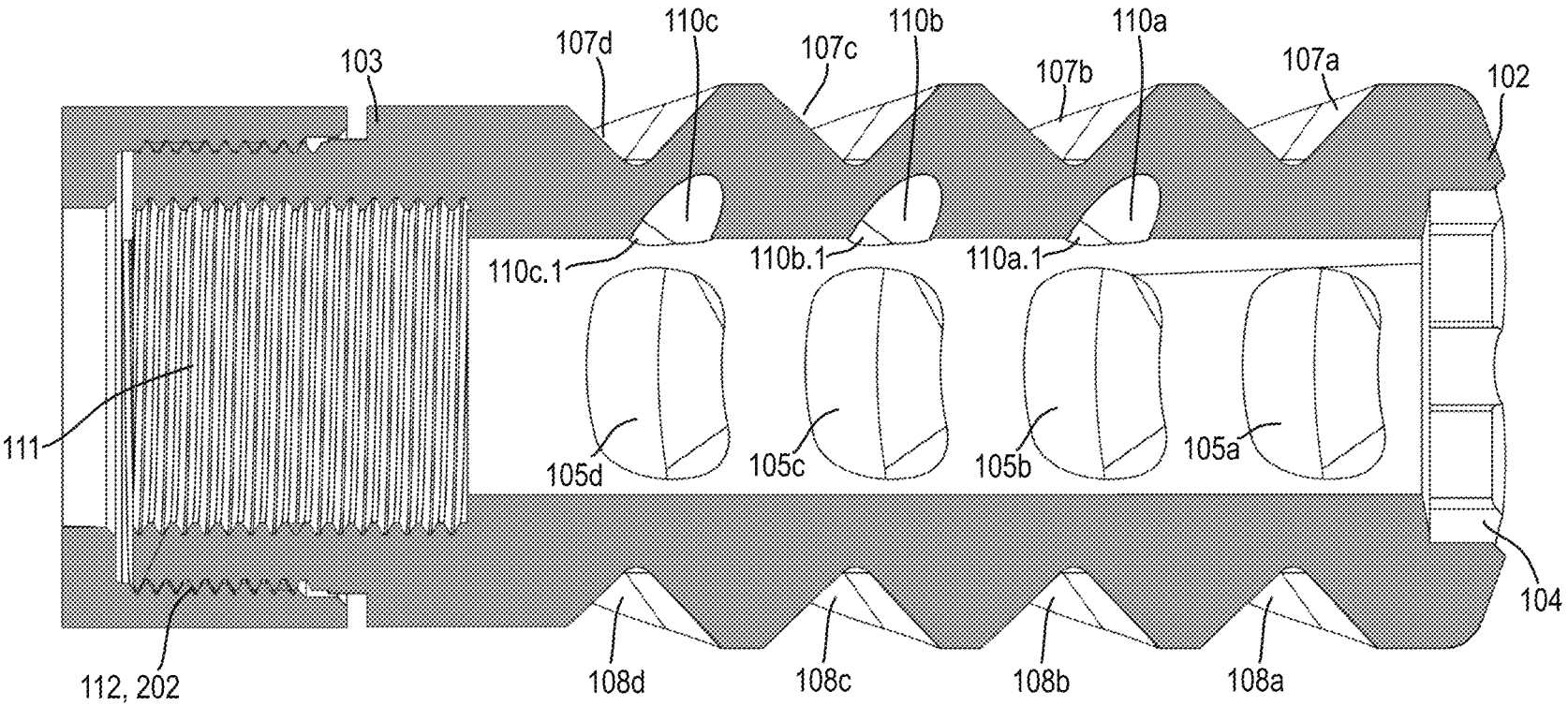
FIG. 6B is a cross-section view of the muzzle device assembly of FIG. 2.
Figure 7A:
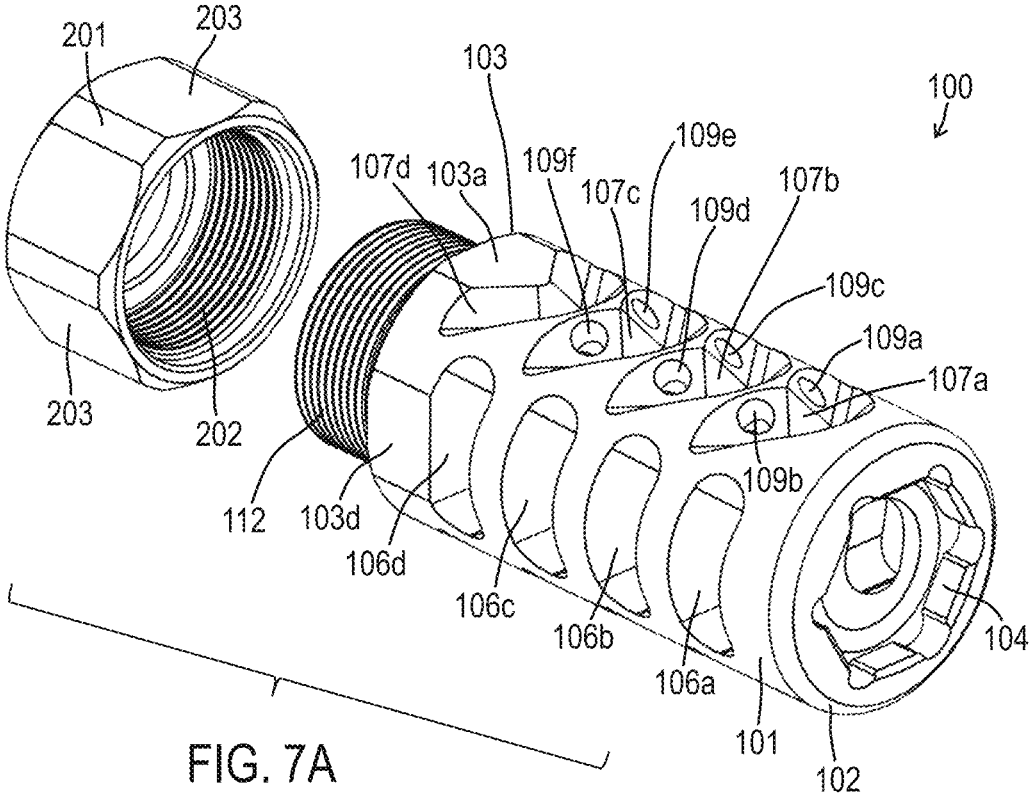
FIG. 7A is an exploded front perspective view of the muzzle device assembly of FIG. 1.
Figure 7B:
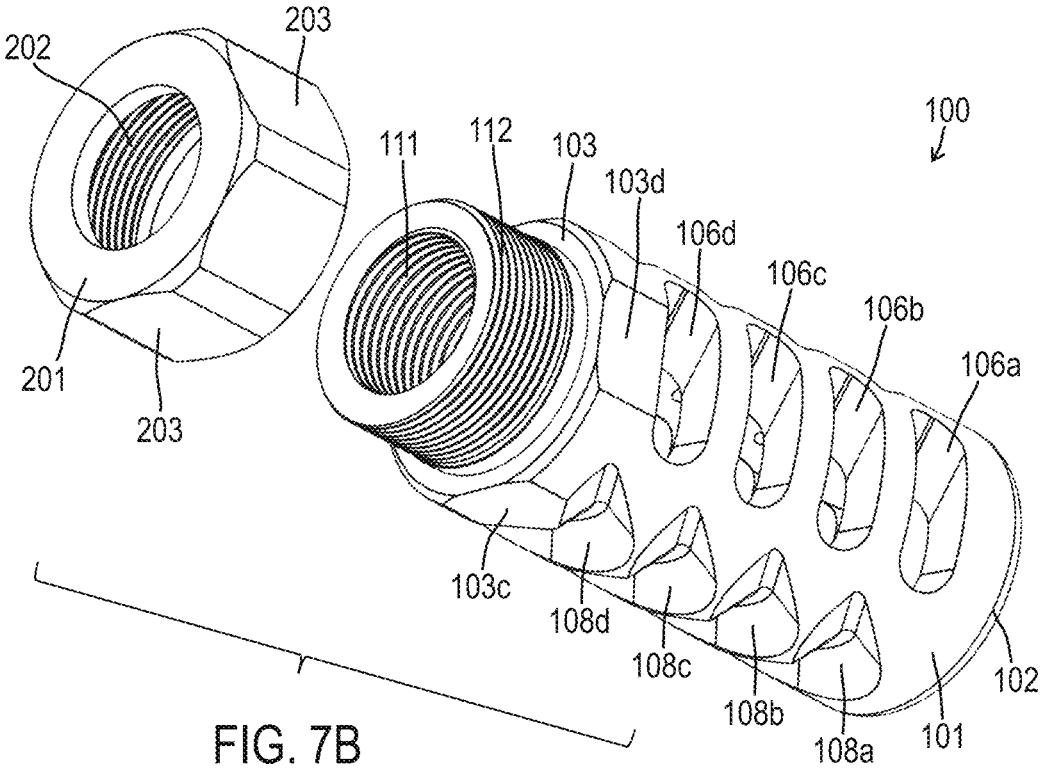
FIG. 7B is an exploded rear perspective view of the muzzle device assembly of FIG. 1.

As discussed above, the geometry of the common holes 110*a-c* are each based on the intersection of two non-parallel openings that extend from the outer surface of the body 101 (see FIGS. 5-6B). As gases move through the barrel 50 and into the muzzle device assembly 100, for each common hole 110, the gases first reach a leading edge configured with an obtuse angle for entering the common hole 110. For example, the gases will first reach leading edge 110*c*.1 of common hole 110*c* such that some gases will enter and eventually pass through both opening 109*e* and opening 109*f*. Some gases will also reach leading edge 110*b*.1 of common hole 110*b* such that some gases will enter and eventually pass through both opening 109*c* and opening 109*d*. Finally, some gases will also reach leading edge 110*a*.1 of common hole 110*a* such that some gases will enter and eventually pass through both opening 109*a* and opening 109*b*.

Figure 8:
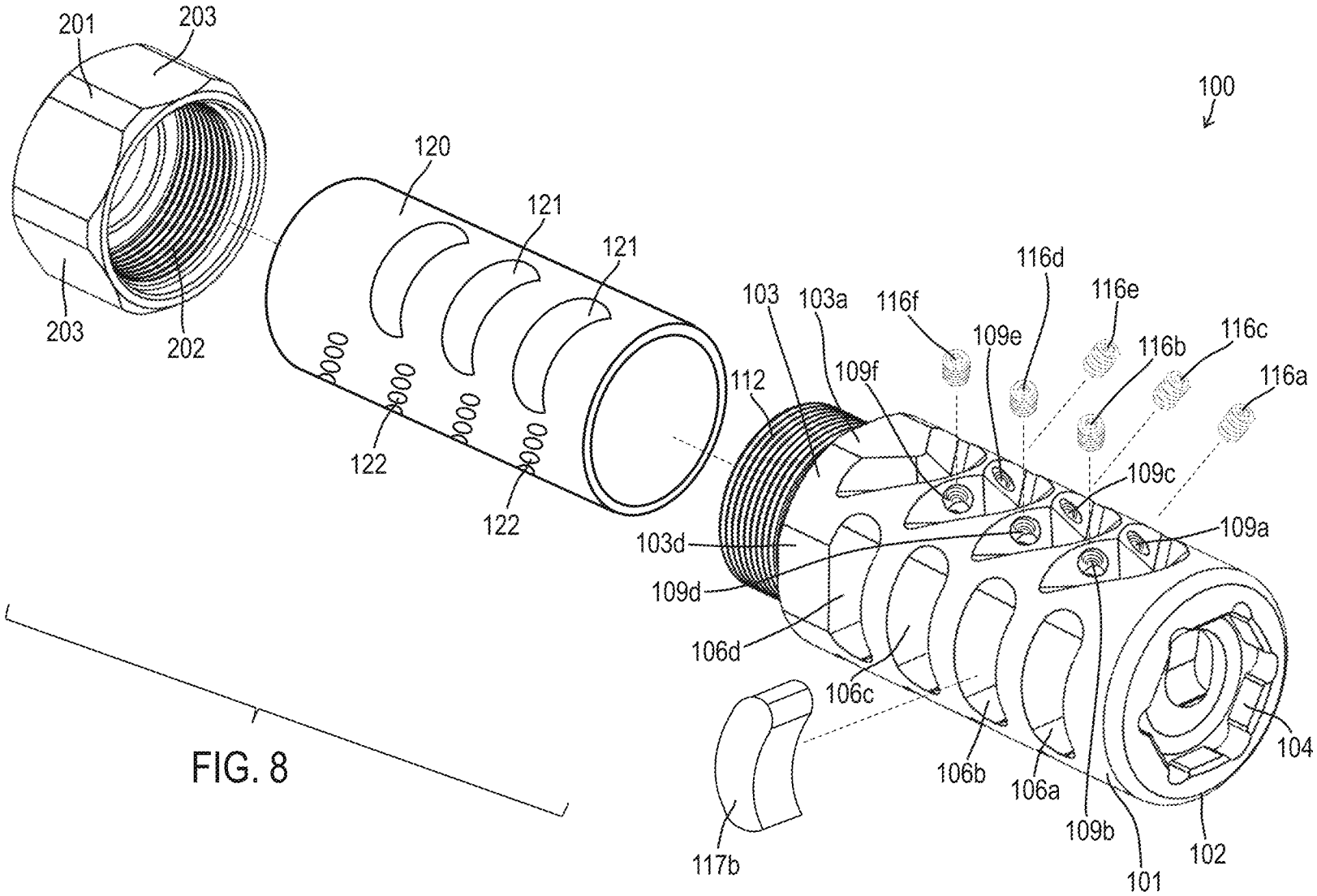
FIG. 8 is an exploded front perspective view of the muzzle device assembly of FIG. 1.

As shown in FIG. 8, in some embodiments, the flow of gases through at least one of the openings 105, 106, 109 can be tuned, reduced, and/or eliminated. For example, one or more of the openings 109 may be a threaded hole such that a fastener 116 can be threaded into the opening 109. As shown in FIG. 8, a fastener 116*a* may be inserted into opening 109*a*, a fastener 116*b* may be inserted into opening 109*b*, a fastener 116*c* may be inserted into opening 109*c*, a fastener 116*d* may be inserted into opening 109*d*, a fastener 116*e* may be inserted into opening 109*e*, and a fastener 116*f* may be inserted into opening 109*f*. Each fastener 116 may be a set screw that completely closes the opening 109 or may be a hollow screw that reduces (but does not eliminate) flow through the opening 109. In addition, the body 101 may include at least one plug 117 for reducing or eliminating flow through the openings 105, 106. Although FIG. 8 only shows plug 117*b* for right side opening 106*b*, the muzzle device assembly 100 may include additional plugs 117 including as many as 8 plugs 117 for each of the openings 105, 106. In addition, the muzzle device assembly 100 may include an insert 120 that is disposed within the interior of the body 101 and captured/secured by threading the rear member 201 (or nut 201) onto the rear of the body 101. The insert 120 may include at least one large opening 121 and at least one array of small holes 122. In some embodiments, the insert 120 can be twisted or rotated to align more or less of the large opening(s) 121 and/or the array(s) of small holes 122 with the openings 105, 106, 109.

The components of any of the components described herein may be formed of materials including, but not limited to, thermoplastic, carbon composite, plastic, nylon, polyethylene, polyetherimide, polypropylene, polyvinyl chloride, steel, aluminum, stainless steel, high strength aluminum alloy, tool steel, other plastic or polymer materials, other metallic materials, other composite materials, or other similar materials. Moreover, the components of the devices described herein may be attached to one another via suitable fasteners, which include, but are not limited to, screws, bolts, rivets, welds, over-molding, co-molding, injection molding, or other mechanical or chemical fasteners.

Different arrangements of the components depicted in the drawings or described above, as well as components and steps not shown or described, are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A muzzle device assembly for a firearm comprising:
a body; and
a rear member attached to a rear of the body, wherein:
the body comprises a plurality of openings on a left side of the body and a plurality of openings on a right side of the body;
at least one pair of openings on a top of the body;
the at least one pair of openings intersect one another and form a common hole at an interior surface of the body;
the plurality of openings on the left side of the body comprises at least four slotted openings extending from the interior surface of the body to an exterior of the body; and
the plurality of openings on the right side of the body comprises at least four slotted openings extending from the interior surface of the body to the exterior of the body.

2. The muzzle device assembly of claim 1, wherein the body comprises an inner attachment portion for securing the muzzle device assembly to a barrel of the firearm.

3. The muzzle device assembly of claim 1, wherein the rear member comprises a nut.

4. The muzzle device assembly of claim 3, wherein the nut comprises left hand threads.

5. The muzzle device assembly of claim 1, wherein each of the at least one pair of openings is perpendicular to an exterior surface where the opening passes through the exterior surface.

6. The muzzle device assembly of claim 1, wherein the body further comprises a front recess configured to engage with a tool.

7. The muzzle device assembly of claim 1, further comprising a portion inserted into each of the at least one pair of openings to at least partially reduce a flow of gases through the at least one pair of openings.

8. The muzzle device assembly of claim 1, further comprising a plug inserted into at least one of the plurality of openings on the left side of the body or the plurality of openings on the right side of the body.

9. The muzzle device assembly of claim 1, wherein at least one of the plurality of openings on the left side of the body or the plurality of openings on the right side of the body extend at least partially through the body at an oblique angle relative to a bore axis of the muzzle device.

10. A muzzle device assembly for a firearm comprising:
a body comprising:
at least one opening on a left side of the body;
at least one opening on a right side of the body;
at least one upper recess;
at least one lower recess; and
at least one pair of openings on a top of the body, wherein:
the at least one pair of openings are disposed in the at least one upper recess or the at least one lower recess; and
the at least one pair of openings intersect one another and form a common hole at an interior surface of the body.

11. The muzzle device assembly of claim 10, wherein at least one of the at least one upper recess or the at least one lower recess do not protrude to the interior surface of the body.

12. The muzzle device assembly of claim 10, further comprising a rear member attached to a rear of the body.

13. The muzzle device assembly of claim 12, wherein the rear member comprises a nut comprising left hand threads.

14. The muzzle device assembly of claim 10, wherein:
the at least one opening on the left side of the body comprises at least four slotted openings extending from the interior surface of the body to an exterior of the body; and
the at least one opening on the right side of the body comprises at least four slotted openings extending from the interior surface of the body to the exterior of the body.

15. The muzzle device assembly of claim 10, wherein each of the at least one pair of openings is perpendicular to an exterior surface where the opening passes through the exterior surface.

16. The muzzle device assembly of claim 10, wherein the body further comprises a front recess configured to engage with a tool.

17. The muzzle device assembly of claim 10, further comprising a portion inserted into each of the at least one pair of openings to at least partially reduce a flow of gases through the at least one pair of openings.

18. The muzzle device assembly of claim 10, further comprising a plug inserted into at least one of the plurality of openings on the left side of the body or the plurality of openings on the right side of the body.

19. The muzzle device assembly of claim 10, wherein at least one of the plurality of openings on the left side of the body or the plurality of openings on the right side of the body extend at least partially through the body at an oblique angle relative to a bore axis of the muzzle device.

20. A muzzle device assembly for a firearm comprising:
a body comprising:
at least one opening on a left side of the body;
at least one opening on a right side of the body;
at least one upper recess;
at least one lower recess; and
at least one pair of openings on a top of the body, wherein:
the at least one pair of openings intersect one another and form a common hole at an interior surface of the body; and
at least one of the at least one upper recess or the at least one lower recess do not protrude to the interior surface of the body.

* * * * *